US010037679B1

(12) United States Patent
Crosby

(10) Patent No.: US 10,037,679 B1
(45) Date of Patent: Jul. 31, 2018

(54) GARBAGE REMINDER SYSTEM

(71) Applicant: Bengi Crosby, Hoboken, GA (US)

(72) Inventor: Bengi Crosby, Hoboken, GA (US)

( * ) Notice: Subject to any disclaimer, the term of this patent is extended or adjusted under 35 U.S.C. 154(b) by 0 days.

(21) Appl. No.: 15/417,794

(22) Filed: Jan. 27, 2017

(51) Int. Cl.

| | |
|---|---|
| ***G08B 25/00*** | (2006.01) |
| ***G08B 21/24*** | (2006.01) |
| ***B65F 1/02*** | (2006.01) |
| ***B65F 1/16*** | (2006.01) |
| ***B65F 1/14*** | (2006.01) |
| ***F21V 23/04*** | (2006.01) |
| ***F21V 33/00*** | (2006.01) |
| ***F21L 4/02*** | (2006.01) |

(52) U.S. Cl.
CPC ..... *G08B 21/24* (2013.01); *B65F 1/02* (2013.01); *B65F 1/1473* (2013.01); *B65F 1/1646* (2013.01); *F21L 4/02* (2013.01); *F21V 23/04* (2013.01); *F21V 33/004* (2013.01); *B65F 2210/139* (2013.01)

(58) Field of Classification Search
CPC ..... G08B 21/24
USPC ..... 340/309.7
See application file for complete search history.

(56) References Cited

U.S. PATENT DOCUMENTS 4,860,267 A * 8/1989 Herrington ..... B65F 1/14 220/908
5,828,312 A 10/1998 Yamazaki
5,910,931 A 6/1999 Pettyjohn
5,967,355 A 10/1999 Ragot
D640,027 S 6/2011 Strempack et al.
8,810,361 B2 8/2014 Thukral et al.
2004/0127355 A1* 7/2004 Manu ..... B09B 1/00 502/400
2009/0126473 A1* 5/2009 Porat ..... B65F 1/1426 73/149
2009/0261548 A1* 10/2009 Sheehan ..... B65F 1/1468 280/47.26
2012/0075099 A1* 3/2012 Brown ..... G08B 5/36 340/540
2014/0172953 A1* 6/2014 Blanksteen ..... H04W 4/02 709/203
2016/0071396 A1* 3/2016 Call ..... G08B 21/24 340/686.6
2016/0176630 A1* 6/2016 Shahabdeen ..... B65F 1/00 206/459.1
2016/0189527 A1* 6/2016 Peterson ..... G08B 25/008 340/541
2016/0292633 A1* 10/2016 Griffin ..... G06K 7/10861
2016/0292995 A1* 10/2016 Warren ..... H04L 12/6418
2016/0379468 A1* 12/2016 Wu ..... G08B 21/24 340/632
2017/0183151 A1* 6/2017 Starkey ..... B65F 1/1484
2017/0193798 A1* 7/2017 Call ..... G08B 21/24

* cited by examiner

*Primary Examiner* — Santiago Garcia

(57) ABSTRACT

A garbage reminder system for reminding a user to place a garbage can for pickup includes a garbage can that has an outer wall. An alarm unit is provided and the alarm unit is coupled to the garbage can. The alarm unit is programmable to emit an audible alarm at a selected time and date. In this way the alarm unit issues a reminder to set the garbage can at a curb for pickup.

11 Claims, 6 Drawing Sheets

GARBAGE REMINDER SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to reminder devices and more particularly pertains to a new reminder device for reminding a user to place a garbage can for pickup.

BRIEF SUMMARY OF THE INVENTION

An embodiment of the disclosure meets the needs presented above by generally comprising a garbage can that has an outer wall. An alarm unit is provided and the alarm unit is coupled to the garbage can. The alarm unit is programmable to emit an audible alarm at a selected time and date. In this way the alarm unit issues a reminder to set the garbage can at a curb for pickup.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
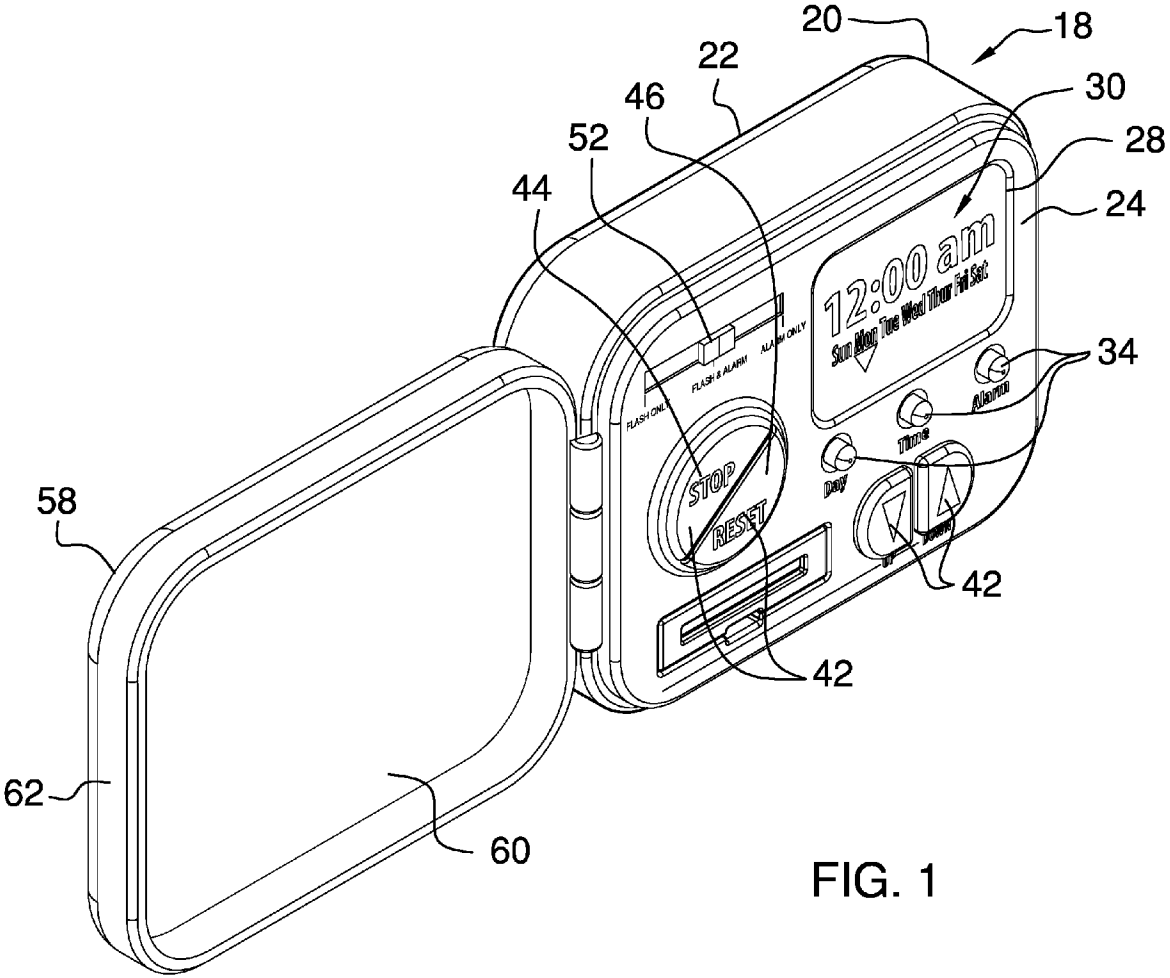
FIG. 1 is a front perspective view of a garbage reminder system according to an embodiment of the disclosure.
Figure 2:
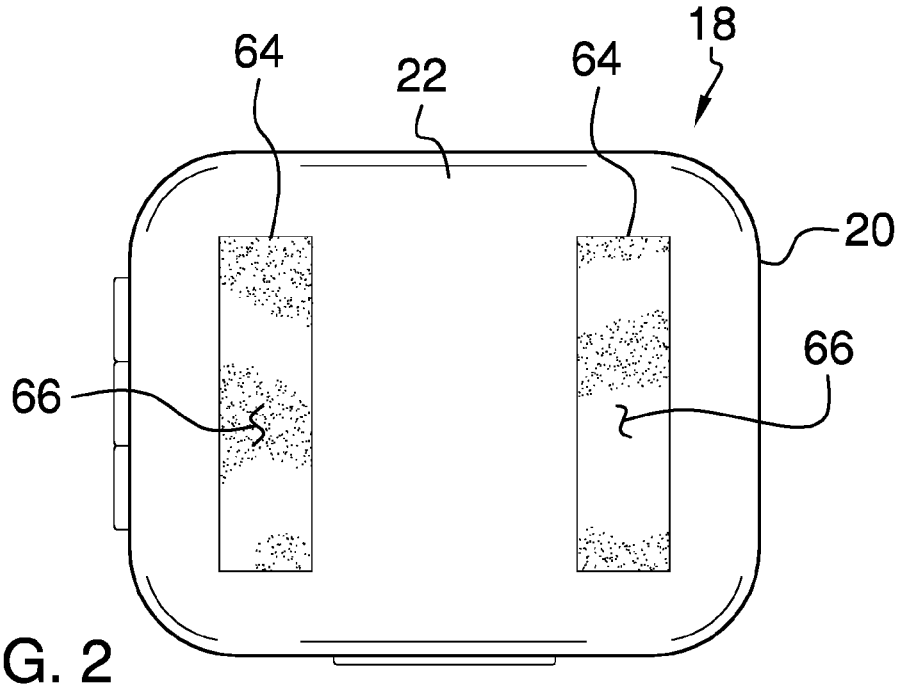
FIG. 2 is a back view of an embodiment of the disclosure.
Figure 3:
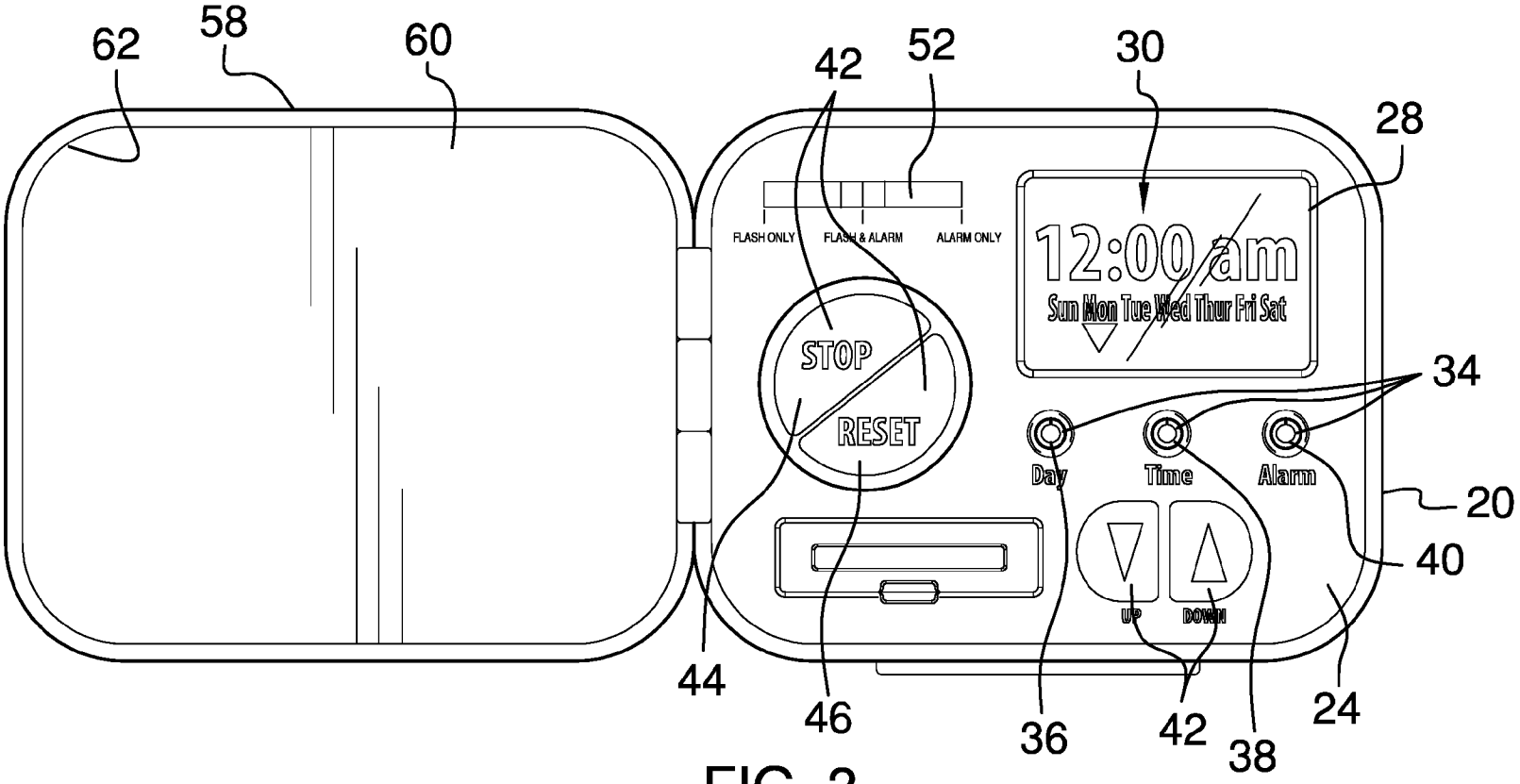
FIG. 3 is a front view of an embodiment of the disclosure.
Figure 4:
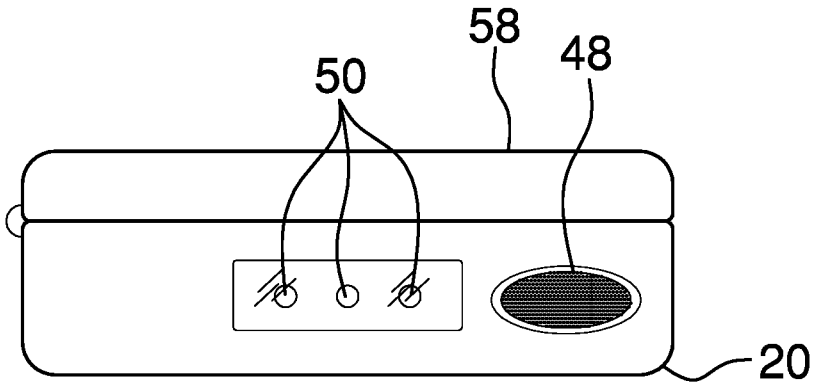
FIG. 4 is a bottom view of an embodiment of the disclosure.
Figure 5:
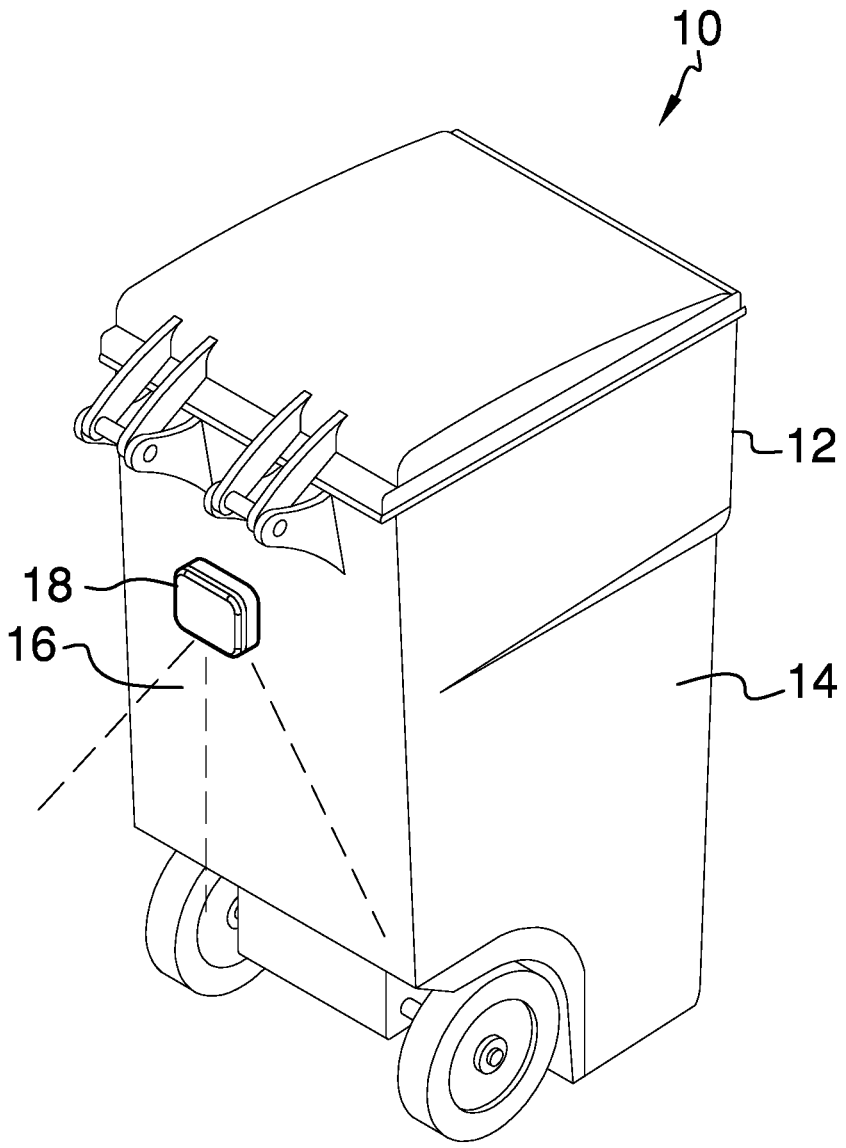
FIG. 5 is a perspective in-use view of an embodiment of the disclosure.
Figure 6:
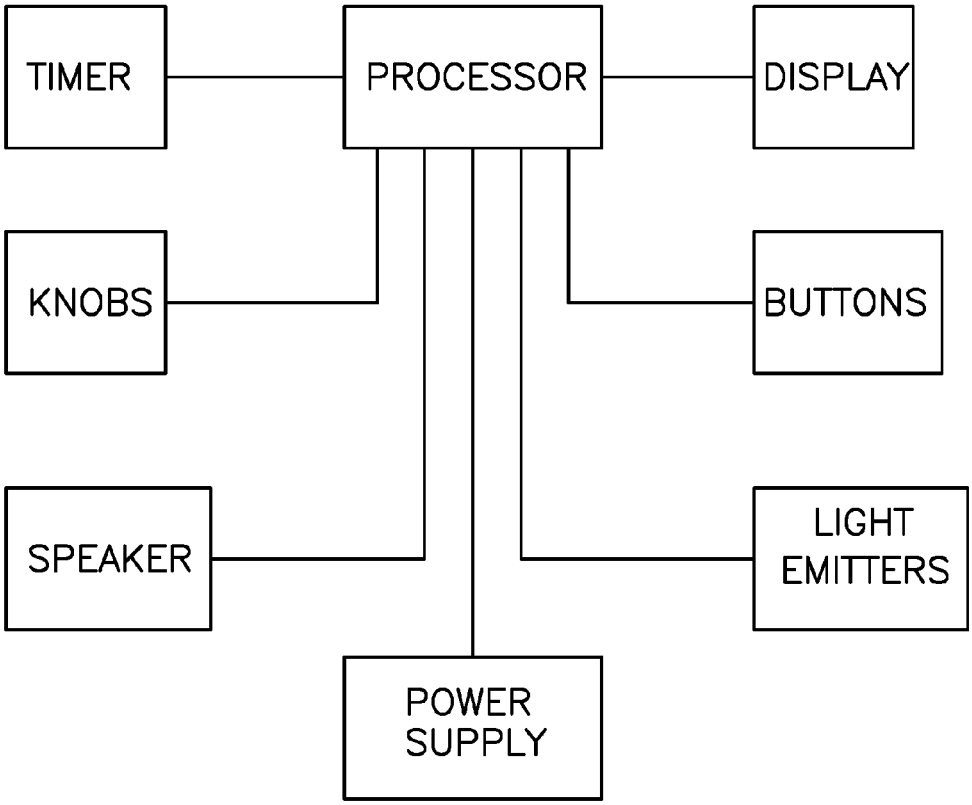
FIG. 6 is a schematic view of an embodiment of the disclosure.

With reference now to the drawings, and in particular to FIGS. 1 through 6 thereof, a new reminder device embodying the principles and concepts of an embodiment of the disclosure and generally designated by the reference numeral 10 will be described.

As best illustrated in FIGS. 1 through 6, the garbage reminder system 10 generally comprises a garbage can 12 that has an outer wall 14 and the outer wall 14 has a back side 16. The garbage can 12 may be a plastic garbage can or the like that is periodically emptied by a garbage company. Additionally, the garbage can 12 is periodically placed at a curb to facilitate the garbage company to empty the garbage can 12.

An alarm unit 18 is provided and the alarm unit 18 is coupled to the garbage can 12. The alarm unit 18 is programmable to emit an audible alarm at a selected time and date corresponding to a time and date that the garbage company empties the garbage can 12. In this way the alarm unit 18 issues a reminder to set the garbage can 12 at the curb for pickup.

The alarm unit 18 comprises a housing 20 has a back wall 22 and a front wall 24. A processor 26 is positioned within the housing 20 and the processor 26 selectively generates an alarm sequence. The processor 26 may be an electronic processor 26 or the like.

A display 28 is coupled to the front wall 24 of the housing 20 such that the display 28 is visible. The display 28 is electrically coupled to the processor 26 and the display 28 displays indicia 30. The indicia 30 comprise a weekly calendar and a time of day. Moreover, the display 28 may be an LCD display 28 or the like. A timer 32 is positioned within the housing 20 and the timer 32 is electrically coupled to the processor 26. The timer 32 stores a weekly calendar and the timer 32 tracks a time of day. The timer 32 may be an electronic timer 32 or the like.

A plurality of knobs 34 is provided and each of the knobs 34 is rotatably coupled to the front wall 24 of the housing 20. Each of the knobs 34 is electrically coupled to the processor 26 and each of the knobs 34 is selectively manipulated. The plurality of knobs 34 includes a day knob 36, a time knob 38 and an alarm knob 40. The day knob 36 selects one of the days of the weekly calendar as a trigger day. The time knob 38 selects a trigger time and the processor 26 generates the alarm sequence on the trigger time of the trigger day.

A plurality of buttons 42 is provided and each of the buttons 42 is movably coupled to the front wall 24 of the housing 20. Each of the buttons 42 is electrically coupled to the processor 26 and each of the buttons 42 may be manipulated. The plurality of buttons 42 controls operational parameters of the processor 26. The plurality of buttons 42 includes a stop button 44 and a reset button 46. The stop button 44 stops the alarm sequence when the stop button 44 is manipulated and the reset button 46 resets the trigger day and the trigger time to a predetermined default.

A speaker 48 is coupled to the housing 20 to emit an audible alarm and the speaker 48 is electrically coupled to the processor 26. The processor 26 turns the speaker 48 on when the processor 26 generates the alarm sequence. In this way the speaker 48 audibly alerts a user to position the garbage can 12 at the curb for pickup. The speaker 48 may be an electronic speaker 48 or the like.

A plurality of light emitters 50 is provided and each of the light emitters 50 is coupled to the housing 20 to emit light. Each of the light emitters 50 is electrically coupled to the processor 26. The processor 26 turns each of the light emitters 50 on when the processor 26 generates the alarm sequence. In this way each of the light emitters 50 visually alerts the user to position the garbage can 12 at the curb for pickup. Each of the light emitters 50 may be an LED or the like.

A switch 52 is slidably coupled to the front wall 24 of the housing 20 and the switch 52 is selectively manipulated. The switch 52 is electrically coupled to the processor 26. The switch 52 is selectively positioned in a flash position such that only the light emitters 50 are turned on when the processor 26 generates the alarm sequence. The switch 52 is selectively positioned in a flash and an alarm position such that the plurality of light emitters 50 and the speaker 48 are turned on when the processor 26 generates the alarm sequence. Lastly, the switch 52 is selectively positioned in an alarm position such that only the speaker 48 is turned on when the processor 26 generates the alarm sequence.

A power supply 54 is removably positioned within the housing 20 and the power supply 54 is electrically coupled to the processor 26. The power supply 54 comprises at least one battery 56. A lid 58 is hingedly coupled to the housing 20 such that the lid 58 selectively covers the housing 20 when the lid 58 is closed. The lid 58 has a first wall 60 and a perimeter wall 62 extending away therefrom. The perimeter wall 62 is hingedly coupled to the front wall 24 of the housing 20. Additionally, the lid 58 forms a fluid impermeable seal with the housing 20 when the lid 58 is closed.

A pair of mating members 64 is provided and each of the mating members 64 is coupled to the back wall 22 of the housing 20. Each of the mating members 64 engages the back side 16 of the garbage can 12 such that the housing 20 is retained on the garbage can 12. Each of the mating members 64 has an outwardly facing surface 66 and the outwardly facing surface 66 corresponding to each of the mating members 64 engages the garbage can 12. Each of the mating members 64 may comprise an adhesive strip or the like.

In use, the housing 20 is manipulated to facilitate each of the mating members 64 to engage the garbage can 12. Additionally, the housing 20 is centrally positioned on the back side 16 of the garbage can 12 to inhibit the housing 20 from being engaged by the garbage company when the garbage can 12 is emptied. Each of the knobs 34 is manipulated to select the trigger day and the trigger time. The processor 26 generates the alarm sequence at the trigger time of the trigger day. Each of the light emitters 50 and the speaker 48 selectively alerts the user to place the garbage can 12 at the curb for pickup. In this way the alarm unit 18 inhibits the user from forgetting to place the garbage can 12 for pickup. The stop button 44 is manipulated when the garbage can 12 is placed at the curb to stop the alarm sequence.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A garbage reminder system comprising:

a garbage can having an outer wall, said outer wall having a back side, said garbage can having a top pivotally coupled to said outer wall by hinges extending rearwardly above said back side of said outer wall wherein said top is configured to selectively cover an upper edge of said outer wall;

an alarm unit being coupled to said garbage can, said alarm unit being programmable to emit an audible alarm at a selected time and date wherein said alarm unit is configured to issue a reminder to set the garbage can at a curb for pickup, said alarm unit comprising a housing having a back wall and a front wall, wherein said alarm unit comprises a processor being positioned within said housing, said processor selectively generating an alarm sequence;

a lid being hingedly coupled to said housing such that said lid selectively covers said front wall of said housing when said lid is closed, said lid having a first wall and a perimeter wall extending away therefrom, said perimeter wall being hingedly coupled to said front wall of said housing; and a pair of mating members, each of said mating members being coupled to said back wall of said housing, each of said mating members engaging said back side of said garbage can such that said housing is retained on said garbage can such that said hinges are positioned overhanging said housing;

a plurality of light emitters, each of said light emitters being coupled to said housing wherein each of said light emitters is configured to emit light, each of said light emitters being electrically coupled to said processor, said processor turning each of said light emitters on when said processor generates said alarm sequence wherein each of said light emitters is configured to visually alert to position said garbage can at the curb for pickup.

2. The system according to claim 1, further comprising a display being coupled to said front wall of said housing wherein said display is configured to be visible, said display being electrically coupled to said processor, said display displaying indicia, said indicia comprising a weekly calendar and a time of day.

3. The system according to claim 1, further comprising a timer being positioned within said housing, said timer being electrically coupled to said processor, said timer storing a weekly calendar, said timer tracking a time of day.

4. The system according to claim 1, further comprising a plurality of knobs, each of said knobs being rotatably coupled to said front wall of said housing wherein each of said knobs is configured to be manipulated, each of said knobs being electrically coupled to said processor.

5. The system according to claim 4, wherein said plurality of knobs includes a day knob, a time knob and an alarm knob, said day knob selecting one of the days of the weekly calendar as a trigger day, said time knob selecting a trigger time, said processor generating said alarm sequence on said trigger time of said trigger day.

6. The system according to claim 1, further comprising a plurality of buttons, each of said buttons being movably coupled to said front wall of said housing wherein each of said buttons is configured to be manipulated, each of said buttons being electrically coupled to said processor.

7. The system according to claim 6, wherein said plurality of buttons controls operational parameters of said processor, said plurality of buttons including a stop button and a reset button, said stop button stopping said alarm sequence when said stop button is manipulated, said reset button resetting said trigger day and said trigger time to a default.

8. The system according to claim 1, further comprising a speaker being coupled to said housing wherein said speaker is configured to emit an audible alarm, said speaker being electrically coupled to said processor, said processor turning said speaker on when said processor generates said alarm sequence wherein said speaker is configured to audibly alert to position said garbage can at the curb for pickup.

9. The system according to claim 1, further comprising:

a speaker, said speaker being positioned on a sidewall of said housing between said front wall and said back wall; and a switch being slidably coupled to said front wall of said housing wherein said switch is configured to be manipulated, said switch being electrically coupled to said processor, said switch being selectively positioned in a flash position such that only said light emitters are turned on when said processor generates said alarm sequence, said switch being selectively positioned in a flash and alarm position such that said plurality of light emitters and said speaker are turned on when said processor generates said alarm sequence, said switch being selectively positioned in an alarm position such that only said speaker is turned on when said processor generates said alarm sequence.

10. The system according to claim 1, further comprising a power supply being removably positioned within said housing, said power supply being electrically coupled to said processor, said power supply comprising at least one battery.

11. A garbage reminder system comprising:

a garbage can having an outer wall, said outer wall having a back side, said garbage can having a top pivotally coupled to said outer wall by hinges extending rearwardly above said back side of said outer wall wherein said top is configured to selectively cover an upper edge of said outer wall;

an alarm unit being coupled to said garbage can, said alarm unit being programmable to emit an audible alarm at a selected time and date wherein said alarm unit is configured to issue a reminder to set the garbage can at a curb for pickup, said alarm unit comprising:

a housing having a back wall and a front wall, a processor being positioned within said housing, said processor selectively generating an alarm sequence, a display being coupled to said front wall of said housing wherein said display is configured to be visible, said display being electrically coupled to said processor, said display displaying indicia, said indicia comprising a weekly calendar and a time of day, a timer being positioned within said housing, said timer being electrically coupled to said processor, said timer storing a weekly calendar, said timer tracking a time of day, a plurality of knobs, each of said knobs being rotatably coupled to said front wall of said housing wherein each of said knobs is configured to be manipulated, each of said knobs being electrically coupled to said processor, said plurality of knobs including a day knob, a time knob and an alarm knob, said day knob selecting one of the days of the weekly calendar as an trigger day, said time knob selecting a trigger time, said processor generating said alarm sequence on said trigger time of said trigger day, a plurality of buttons, each of said buttons being movably coupled to said front wall of said housing wherein each of said buttons is configured to be manipulated, each of said buttons being electrically coupled to said processor, said plurality of buttons controlling operational parameters of said processor, said plurality of buttons including a stop button and a reset button, said stop button stopping said alarm sequence when said stop button is manipulated, said reset button resetting said trigger day and said trigger time to a default, a speaker being coupled to said housing, said speaker being positioned on a sidewall of said housing between said front wall and said back wall wherein said speaker is configured to emit an audible alarm, said speaker being electrically coupled to said processor, said processor turning said speaker on when said processor generates said alarm sequence wherein said speaker is configured to audibly alert to position said garbage can at the curb for pickup, a plurality of light emitters, each of said light emitters being coupled to said housing wherein each of said light emitters is configured to emit light, each of said light emitters being electrically coupled to said processor, said processor turning each of said light emitters on when said processor generates said alarm sequence wherein each of said light emitters is configured to visually alert to position said garbage can at the curb for pickup, a switch being slidably coupled to said front wall of said housing wherein said switch is configured to be manipulated, said switch being electrically coupled to said processor, said switch being selectively positioned in a flash position such that only said light emitters are turned on when said processor generates said alarm sequence, said switch being selectively positioned in a flash and alarm position such that said plurality of light emitters and said speaker are turned on when said processor generates said alarm sequence, said switch being selectively positioned in an alarm position such that only said speaker is turned on when said processor generates said alarm sequence, and a power supply being removably positioned within said housing, said power supply being electrically coupled to said processor, said power supply comprising at least one battery;

a lid being hingedly coupled to said housing such that said lid selectively covers said front wall of said housing when said lid is closed, said lid having a first wall and a perimeter wall extending away therefrom, said perimeter wall being hingedly coupled to said front wall of said housing; and a pair of mating members, each of said mating members being coupled to said back wall of said housing, each of said mating members engaging said back side of said garbage can such that said housing is retained on said garbage can such that said hinges are positioned overhanging said housing.

* * * * *